US012722200B2

(12) United States Patent
Nocera et al.

(10) Patent No.: US 12,722,200 B2
(45) Date of Patent: Sep. 1, 2026

(54) ESTERS OF EPOXIDIZED FATTY ACIDS IN FURFURYL ALCOHOL BINDERS

(71) Applicant: ASK Chemicals LLC, Wilmington, DE (US)

(72) Inventors: Michael R. Nocera, Powell, OH (US); Julen Bascaran, Columbus, OH (US)

(73) Assignee: ASK Chemicals LLC, Wilmington, DE (US)

( * ) Notice: Subject to any disclaimer, the term of this patent is extended or adjusted under 35 U.S.C. 154(b) by 413 days.

(21) Appl. No.: 18/389,041

(22) Filed: Nov. 13, 2023

(65) Prior Publication Data

US 2024/0157432 A1 May 16, 2024

Related U.S. Application Data

(60) Provisional application No. 63/383,298, filed on Nov. 11, 2022.

(51) Int. Cl.
*B22C 1/24* (2006.01)
*B22C 1/22* (2006.01)

(52) U.S. Cl.
CPC ..... *B22C 1/24* (2013.01); *B22C 1/224* (2013.01)

(58) Field of Classification Search
CPC ..... B22C 1/24; B22C 1/224; B22C 1/2253
See application file for complete search history.

(56) References Cited

U.S. PATENT DOCUMENTS

| | | | | |
|---|---|---|---|---|
| 3,409,579 | A | 11/1968 | Robins | |
| 3,676,392 | A | 7/1972 | Robins | |
| 4,412,088 | A | 10/1983 | Gruber | |
| 7,125,914 | B2 * | 10/2006 | Chang | B22C 1/224 523/144 |
| 9,321,901 | B2 | 4/2016 | Frenkel et al. | |
| 11,434,318 | B2 * | 9/2022 | Xing | C08G 65/48 |
| 11,590,561 | B2 * | 2/2023 | Kawakami | C04B 26/105 |
| 2003/0055125 | A1 * | 3/2003 | Hutchings | B22C 1/20 523/139 |

FOREIGN PATENT DOCUMENTS

| | | | | |
|---|---|---|---|---|
| CN | 101691524 | A | 4/2010 | |
| WO | WO-0166281 | A1 * | 9/2001 | B22C 1/224 |

* cited by examiner

*Primary Examiner* — Anthony J Green
(74) *Attorney, Agent, or Firm* — Standley Law Group LLP; Jeffrey S. Standley; Kenny W. Pung

(57) ABSTRACT

A binder system for metal casting has a reactive furan resin, furfuryl alcohol, and a plasticizer that includes an epoxidized fatty acid. The reactive furan resin is a resin modified with phenolic resole, present at from about 18 wt. % to about 22 wt. %, based on the weight of the binder system. The plasticizer may include plant seed oil, such as soybean oil, linseed oil, rapeseed oil, cottonseed oil, sunflower oil and mixtures thereof, present at between about 4 wt. % to about 9 wt. %, based on the weight of the binder system. The furfuryl alcohol and the plasticizer are collectively present in an amount ranging from about 75 wt. % to about 85 wt. %, based on the weight of the binder system. Silane may also be present in an amount from about 0.1 wt. % to about 0.5 wt. %, based on the weight of the binder system.

14 Claims, No Drawings

ESTERS OF EPOXIDIZED FATTY ACIDS IN FURFURYL ALCOHOL BINDERS

CROSS-REFERENCE TO RELATED APPLICATIONS

This patent application is a non-provisional of U.S. Provisional Application No. 63/383,298, filed Nov. 11, 2022, which is incorporated by reference as if fully recited herein.

TECHNICAL FIELD

The inventive concept relates to the preparation and use of foundry shapes for casting molten metal, wherein the foundry shapes exhibit improved plasticity and durability. A foundry mix composition of the inventive concept has a large majority of a foundry aggregate and a polymerizable or curable binder, with the inclusion of an amount of an epoxidized fatty acid. The preferred epoxidized fatty acid is obtained from an epoxidized vegetable oil, such as an oil extracted from the seeds of the soybean plant (*Glycine max*), or is an epoxidized tall oil fatty acid. A preferred polymerizable or curable binder system is a furan resin, that is, a binder derived from furfuryl alcohol or furfural. Preferably, the epoxidized fatty acids are derived from renewable resources that are non-food-based and non-fossil fuel based.

BACKGROUND ART

Within the foundry industry, two of the most popular methods of producing foundry molds are the "no-bake" process and the "cold-box" process. Both of these processes originally used a polyurethane binder with a foundry aggregate. U.S. Pat. No. 3,676,392 to Robins teaches a "no-bake" process in which the foundry mix, which includes a liquid curing catalyst, is forced into a pattern, where it cures, providing a foundry shape useful as a mold or core. Even today, this polyurethane is popular, due to high tensile strength, high tunability and control of the ratio of work time to strip time.

In the polyurethane "cold box" process, a foundry mix is prepared by mixing an appropriate foundry aggregate with polyurethane precursors, as taught in U.S. Pat. No. 3,409,579 to Robins. After forcing the foundry mix into a pattern, a catalyst vapor, typically a tertiary amine, is passed through the foundry mix, causing it to cure and provide a foundry shape useful as a mold or core.

In other processes, namely, the "warm-box" and "hot-box" processes, the foundry mix is prepared by mixing the aggregate with a heat reactive binder and catalyst. The foundry mix is shaped by forcing it into a heated pattern that causes the foundry mix to cure, providing a foundry shape useful as a mold or core.

Ashland Oil Inc., a predecessor of the applicant, was a leader in developing polyurethane binders over 50 years ago. The general concepts involved in reacting a polyol resin, typically phenolic in nature, with an isocyanate are well-known, but the specifics are continually investigated to overcome known issues, such as the reactivity of the isocyanate component with moieties other than the polyol resin.

In using these foundry mixes, the combined components are molded and the work time and strip time are measured to ensure the mold is properly cast and safe to handle. "Work time" is defined as the period of time after mixing components where the foundry mix can be molded into patterns before a level of 60 is reached on a Green hardness B scale gauge. "Strip time" is defined as the period of time after the components are mixed where the foundry mix sets and can no longer be worked with. This is the point where a level of 90 is reached on a Green hardness B scale gauge. It is imperative for a foundry production line that work time meets the requirements of the molds being made. Large molds, which can weigh several hundred pounds, may need extended work times to adequately pack the foundry mix into the molds. In addition to adequate strip time requirements, proper binder selection can play a significant impact on the quality of the mold produced.

As an alternative to polyurethane binder systems, furan binders have enjoyed considerable success. Furan binders are known in the metal casting art for providing at least acceptable levels of tensile strength and elastic performance. Moreover, they are known to have lower levels of volatile organic compounds (VOC), free formaldehyde, and free phenol which can result in less odor and smoke produced upon exposure to molten metal, all while maintaining high tensile strength. While furan resins have been modified through the addition of urea-formaldehyde resins, phenolic resole resins, and novolac resins to increase reactivity and reduce cost, little work has been done to improve the plasticization of the resins.

Plasticizers are commonly added to certain polymers, such as poly(vinyl chloride), which have an inherent hardness and brittleness, in order to improve the flexibility of the material, facilitating molding and shaping. A plasticizer can increase the mobility of the polymer chains it bonds to, as well as increasing the durability and flexibility of the bulk polymer. Compounds such as aromatic polyester polyols (PEPO) produced from the reaction of phthalic anhydride with diethylene glycol have been reported to improve plasticity when added to polyurethane binder resins. Common polyester terephthalate plastics can be recycled to produce terephthalic acid. This acid can then be reacted with diethylene glycol to form a polyester polyol, which can be used as plasticizer in furan polymers (as is the case with many commercial furan binders). However, there are also concerns regarding the phthalate plasticizers arising from potential health hazards as well as their petrochemical origins.

The movement away from phthalate esters such as PEPO has caused interest in epoxidized plant oils as plasticizers, as reported by Hosney, et al., *J. Appl. Polym. Sci.*, 2018, 46270.

In foundry settings, increased plasticity of the resin can lead to increases in mold durability, ultimately leading to fewer casting defects. As previously mentioned, polyester polyols have been used increasingly in furan resin systems due to their maintenance of high tensile strength, and increase of elasticity. Further improving this elasticity while maintaining or even improving tensile strength is imperative to the development of higher quality metal casts. Consequently, plasticizers with better performance than PEPO are needed to improve the flexibility needed in furan mold production.

Therefore, it is a further unmet need of the prior art to provide plasticizers for use in binders for metal casting that are renewable and do not rely upon a food product or a fossil fuel as the raw material.

SUMMARY

These and other unmet needs are met by the use of a plasticizer that comprises an epoxidized fatty acid derived from a renewable source, especially a plant seed-based oil, such as a soybean oil or a linseed oil.

Some embodiments are met by a binder system for metal casting that comprises a reactive furan resin, furfuryl alcohol, and a plasticizer comprising an epoxidized fatty acid, preferably a plasticizer derived from a renewable source. Some of these embodiments further comprise an activator.

In many embodiments, the plasticizer comprises at least one of: epoxidized palmitic acid, epoxidized stearic acid, epoxidized oleic acid, epoxidized linoleic acid, epoxidized linolenic acid, and mixtures thereof.

In many embodiments, the plasticizer comprises an unsaturated fatty acid that has from about 14 to about 22 carbon atoms.

In many embodiments, the plasticizer comprises an ester of the epoxidized fatty acid with an alcohol. In many of these embodiments, the alcohol may be glycerol or methanol.

In many embodiments, the plasticizer comprises an epoxidized plant seed oil that comprises glycerides (inclusive of mono-, di-, and triglycerides) with at least one epoxidized fatty acid. In some of these embodiments, the glycerides include at least one of: epoxidized palmitic acid, epoxidized stearic acid, epoxidized oleic acid, epoxidized linoleic acid, and epoxidized linolenic acid. Additionally or alternatively, some of these embodiments may include glycerides with at least one unsaturated fatty acid having from about 14 to about 22 carbon atoms.

In many embodiments, the plasticizer comprises at least one of: epoxidized soybean oil, epoxidized linseed oil, epoxidized rapeseed oil, epoxidized cottonseed oil, epoxidized sunflower oil and mixtures thereof.

In many embodiments, the plasticizer comprises an epoxidized plant seed oil with an epoxidation degree of about 5% to about 11%, preferably from about 7% to about 9%.

In many embodiments, the plasticizer comprises at least one of: epoxidized soybean oil with an epoxidation degree of about 7.1% and epoxidized linseed oil with an epoxidation degree of about 9.0%.

In many embodiments, the plasticizer comprises a methylated epoxidized plant seed oil, preferably methylated epoxidized soybean oil.

In many embodiments, the plasticizer may comprise 2-ethylhexyl tallate, preferably with an epoxidation degree of about 2.0% to about 7.0%, or more preferably about 4.7%.

In many embodiments, the plasticizer may comprise an epoxidized tall oil. In many embodiments, the plasticizer may comprises epoxidized tall oil fatty acids.

In many embodiments, including those described above, the plasticizer may be present in an amount ranging from about 4 wt. % to about 9 wt. %, preferably from about 5 wt. % to about 7.5 wt. %, based on the total weight of the binder system.

In preferred embodiments, the binder system is devoid of phthalate-based plasticizer.

In many embodiments, the reactive furan resin is a furan resin modified with phenolic resole, present in an amount from about 18 wt. % to about 22 wt. %, preferably about 20 wt. %, based on the total weight of the binder system.

In many of the embodiments, the binder system includes a silane, preferably an amino-functional silane. In these embodiments, the silane may be present in an amount ranging from about 0.1 wt. % to about 0.5 wt. %, preferably about 0.25%, based on the total weight of the binder system. In some of these embodiments, silane may be included as an activator.

In many embodiments, the activator may be an aromatic sulfonic acid.

In many embodiments, the furfuryl alcohol is present in an amount from about 64.75 wt. % to about 78.75 wt. %, preferably from about 70.75 wt. % to about 75.75 wt. %, and more preferably from about 72.25 wt. % to about 74.75 wt. %, based on the total weight of the binder system.

In many embodiments, the furfuryl alcohol and the plasticizer may be collectively present in an amount ranging from about 75 wt. % to about 85 wt. %, preferably about 79.75 wt. %, based on the total weight of the binder system.

The inventive concept extends to a foundry molding mix for metal casting that comprises a major amount of foundry aggregate and the aforesaid binder system. Some embodiments of the foundry molding mix may also include a curing catalyst.

In many of the embodiments, the foundry molding mix has the binder system present in the range of from about 0.5 wt. % to about 5 wt. %, preferably about 1.0 wt. %, based on the weight of the foundry aggregate.

In many embodiments, curing catalyst includes a Lewis acid such as an aromatic sulfonic acid. In many of these embodiments, the curing catalyst is present in the amount of about 0.001 wt. % to about 0.005 wt. %, preferably about 0.002 wt. %, based on the weight of the foundry aggregate.

The inventive concept also extends to a method for preparing a foundry shape, comprising the steps of: activating a foundry molding mix by mixing the binder system of any one of the embodiments described above with the foundry aggregate; working the activated foundry molding mix in a mold or pattern to form a foundry shape; allowing the foundry shape to cure in the mold or pattern for a dwell time sufficient to cure the foundry shape; and removing the cured foundry shape from the mold or pattern.

The inventive concept also extends to a foundry shape prepared by this method.

The inventive concept also extends to a metal casting prepared by the steps of: pouring molten metal into a foundry shape embodying the inventive concept; allowing the molten metal to cool and solidify; and separating the metal casting from the foundry shape.

DETAILED DESCRIPTION OF THE EMBODIMENTS

Furan binder systems according to the present invention include a reactive furan resin, furfuryl alcohol, and a plasticizer based on one or more epoxidized fatty acids. Some embodiments thereof may also include an activator (as used herein, the term "activator" refers to a hardener or curing agent). These furan binder systems are at least useful for metal casting applications, serving to bind foundry aggregate during the preparation and use of foundry shapes which can then be used as a mold or core.

In an acidic environment, furfuryl alcohol will react with the epoxide rings of the epoxidized fatty acids, binding the heterocyclic furan rings in an ester linkage along the alkyl chain. This creates branch points for polymeric growth upon further reaction with furfuryl alcohol. The inclusion of epoxidized fatty acids results in a material with improved flexibility which, in turn, facilitates the molding and shaping of foundry shapes.

The epoxidized fatty acids may be derived from a renewable source, i.e., a source of fatty acids that is replenishable via natural reproduction or some other recurring process despite ongoing consumption over a human timeframe. Fossil fuels such as petroleum and natural gas require millions of years to form; they are not considered renewable. Plants, the various components thereof (e.g., seeds, stems, leaves), and the various products produced therefrom (e.g., plant-based oils), are considered renewable.

A preferred renewable source of fatty acids are plant seed oils. This includes, for example, soybean oil, linseed oil, rapeseed oil, cottonseed oil, sunflower oil, and various mixtures thereof. Plant seed oils are preferred because they are generally not considered food product and, at least in comparison to phthalate-based plasticizers, are not especially hazardous to handle.

Plant seed oils contain glycerides, especially triglycerides, that are esters of glycerol with fatty acid. The fatty acids found in plant seed oils typically contain from about 14 to about 22 carbon atoms in each of the hydrocarbon chains, which may either be saturated or may have a varying amount of unsaturation in each chain. As an example, a soybean oil may comprise saturated fatty acids such as palmitic and stearic acid, as well as unsaturated fatty acids such as oleic, linoleic, and linolenic acid. Linseed oil, derived from flax seed, contains a similar blend of saturated and unsaturated fatty acids, but is primarily triply unsaturated linolenic acid.

The chemistry of epoxidizing plant seed oils (or rather, the fatty acids contained in plant seed oils) is generally understood and occurs through catalytic modification of the carbon-carbon double bonds in the fatty acid hydrocarbon chains, thereby generating reactive epoxide rings in a trans configuration along the chains.

In embodiments of the present invention, the plasticizer used in the furan binder system may comprise: epoxidized palmitic acid, epoxidized stearic acid, epoxidized oleic acid, epoxidized linoleic acid, epoxidized linolenic acid, or a mixture thereof. It is further contemplated that other epoxidized fatty acids may be utilized in the plasticizer either in addition to or as an alternative for these epoxidized fatty acids.

For a source of epoxidized fatty acids, including one or more of the epoxidized fatty acids listed above, the plasticizer may comprise: epoxidized soybean oil, epoxidized linseed oil, epoxidized rapeseed oil, epoxidized cottonseed oil, epoxidized sunflower oil, or a mixture thereof. It is further contemplated that other epoxidized plant seed oils may be utilized in the plasticizer either in addition to or as an alternative for these epoxidized plant seed oils.

The epoxidation degree (oxirane content) of the plant seed oils used in the plasticizer may vary. However, it contemplated that an epoxidation degree of about 5% to about 11% is preferred, or more preferably from about 7% to about 9%.

An example of an epoxidized soybean oil that may be suitable for use in the plasticizer includes PLAS-CHEK 775, available from Valtris Specialty Chemicals of Independence, Ohio. This soybean oil has an epoxidation degree of about 7.1%.

An example of an epoxidized linseed oil that may be suitable for use in the plasticizer includes PLASTHALL ELO, available from Hallstar of Chicago, Illinois. This linseed oil has an epoxidation degree of about 9.0%.

In some embodiments, the epoxidized plant seed oil may be trans-esterified to produce fatty acid esters. This process may entail saponifying the glycerides contained in the plant seed oils and the esterification of the fatty acids with an alcohol. For example, epoxidized soybean oil may be trans-esterified by mixing it with NaOH (a strong base serving as a catalyst) and methanol to produce a methylated epoxidized soybean oil. Without being bound by any particular theory, it is contemplated that methylated epoxidized soybean oil, in comparison to non-methylated epoxidized soybean oil, may be more stable in formulations of the furan binder system due to being more polar.

In embodiments of the present invention, the plasticizer may include epoxidized plant seed oil that has been trans-esterified with methanol. In embodiments of the present invention, the plasticizer may include a methylated plant seed oil, particularly methylated epoxidized soybean oil. In embodiments of the present invention, the plasticizer may include an epoxidized plant seed oil that has been trans-esterified with an alcohol other than methanol.

Another preferred source of fatty acids is tall oils. Tall oils are a byproduct of the kraft process of wood pulp manufacture, particularly when pulping coniferous trees. Tall oils comprise rosins, fatty acids, and fatty alcohols, among other things. The main fatty acids found in tall oils are oleic acid, palmitic acid, and linoleic acid, with oleic acid typically being in the largest amount. In embodiments of the present invention, the plasticizer may comprise an epoxidized tall oil. In embodiment of the present invention, the plasticizer may comprise epoxidized tall oil fatty acids.

Tall oils can be used in the synthesis of 2-ethylhexyl epoxy tallate (CAS 61789-01-3), such as by epoxidating tall oil fatty acid with 2-ethylhexanol in the presence of a catalyst. In embodiments of the present invention, the plasticizer may contain 2-ethylhexyl epoxy tallate. In these embodiments, the epoxidation degree of the 2-ethylhexyl epoxy tallate may be from about 2.0% to about 7.0%, or more preferably about 4.7%.

The reactive furan resin utilized in the furan binder system of the present invention may preferably be a furan resin that has been modified with phenolic resole resin. An example of such a reactive furan resin includes CHEM-REZ PFP-99, available from ASK Chemicals of Dublin, Ohio.

It is contemplated that silanes may be suitable for use in the furan binder systems of the present invention as an adhesion promotor, particularly amino-functional silanes. An example of such a silane includes SILANE 1100 (a.k.a., SILQUEST), available from Momentive Performance Materials of Niskayuna, New York, which is the commercial name for γ-aminopropyl triethoxysilane.

In some embodiments, the activator may comprise a silane such as SILANE 1100.

In some embodiments, the activator may comprise a catalyst such as CHEM-REZ C090B Catalyst, available from ASK Chemicals of Dublin, Ohio.

Described below are relative amounts of the reactive furan resin, furfuryl alcohol, silane, and plasticizer that may be present in embodiments of the furan binder system. For clarity regarding how these amounts are described, an example is provided –25 parts by weight reactive furan resin, 25 parts by weight furfuryl alcohol, 25 parts by weight silane, and 25 parts by weight plasticizer will collectively amount to furan binder system that is 100 parts by weight in total (assuming that no other components are included). In such case, each of these four binder system components may be described as being "present in the binder system in the amount of 25.0 weight percent (wt. %), based on the total weight of the binder system".

In embodiments of the present invention, the plasticizer may be present in the furan binder system in an amount ranging from about 1.0 wt. % to about 15.0 wt. %, preferably about 4.0 wt. % to about 9.0 wt. %, and more preferably from about 5.0 wt. % to about 7.5 wt. %, based on the total weight of the binder system.

In embodiments of the present invention, reactive furan resin may be present in the furan binder system in an amount ranging from about 18 wt. % to about 22 wt. %, preferably about 20 wt. %, based on the total weight of the binder system.

In embodiments of the present invention, furfuryl alcohol may be present in the furan binder system in an amount ranging from about 64.75 wt. % to about 78.75 wt. %, preferably from about 70.75 wt. % to about 75.75 wt. %, and more preferably from about 72.25 wt. % to about 74.75 wt. %, based on the total weight of the binder system.

In embodiments of the present invention, silane may be present in the furan binder system in an amount ranging from about 0.1 wt. % to about 0.5 wt. %, preferably about 0.25 wt. %, based on the total weight of the binder system.

In embodiments of the present invention, the plasticizer and the furfuryl alcohol, considered together, may be present in the furan binder system in an amount ranging from about 75 wt. % to about 85 wt. %, preferably about 79.95 wt. %, based on the total weight of the binder system. In these embodiments, the quantity of furfuryl alcohol may be adjusted to account for either more or less plasticizer being added. For example, if the plasticizer is present in the furan binder system at 1, 2.5, 5.0, 7.5, 10 or 15 wt. %, the furfuryl may be present in in the furan binder system at 78.75, 77.25, 74.75, 72.25, 69.75, and 64.75 wt. %, respectively, based on the total weight of the binder system.

The furan binder systems disclosed above are useful in the preparation of foundry molding mixes for metal casting. Such foundry molding mixes will include a furan binder system and a foundry aggregate. Preferred embodiments will further include a curing catalyst.

For foundry molding mixes according to the present invention, the furan binder system may be present in the range of from about 0.5 wt. % to about 5.0 wt. %, preferably about 1.0 wt. %, based on the weight of the foundry aggregate.

For foundry molding mixes according to the present invention, the curing catalyst may include an aromatic sulfonic acid, acting as a Lewis acid. An example of a curing catalyst that may be suitable for use in the present invention includes CHEM-REZ C090B Catalyst, available from ASK Chemicals of Dublin, Ohio. The curing catalyst may preferably be present in an amount ranging from about 0.1 wt. % to about 0.5 wt. % (e.g., about 3.0-15 parts by weight catalyst to about 3000 parts by weight sand), or more preferably from about 0.2 wt. % to about 0.35 wt. % (e.g., about 6.0-10.5 parts by weight catalyst to about 3000 parts by weight sand), based on the weight of the foundry aggregate.

An example of a foundry aggregate that may be suitable for use in the foundry molding mixes of the present invention includes WEDRON 410 silica sand, available from Wedron Silica Co. of Wedron, Illinois.

The present invention relates to a method for preparing a foundry shape. The method comprises the steps of: 1) activating a foundry molding mix by mixing furan binder system with a foundry aggregate; 2) working the activated foundry molding mix in a mold or pattern to form a foundry shape; 3) allowing the foundry shape to cure in the mold or pattern for a dwell time sufficient to cure the foundry shape; and removing the cured foundry shape from the mold or pattern.

The method described above results in a foundry shape, which is another aspect of the present invention.

The present invention further relates to a metal casing that is prepared by the steps of: pouring molten metal into a foundry shape, allowing the molten metal to cool and solidify; and separating the metal casting from the foundry shape.

Experimental Protocol: PEPO, EBSO, and ELO

A first round of experiments tested polyacester polyol (PEPO), epoxidized soybean oil (ESBO), and epoxidized linseed oil (ELO) as plasticizers in furan binder systems. PEPO is considered the standard plasticizer and was used as a control to compare EBSO and ELO against. For each of these plasticizers, a series of furan binder systems was prepared by mixing 20 parts by weight of a reactive furan resin, 0.25 parts by weight of SILANE 1100, and varying amounts of plasticizer and furfuryl alcohol. The tested amounts of plasticizer were 1.0, 2.5, 5.0, 7.5, 10.0, and 15.0 parts by weight. Furfuryl alcohol was added in an amount needed such that the plasticizer and the furfuryl alcohol collectively totaled 79.75 parts by weight (e.g., 1 part by weight plasticizer+78.75 parts by weight furfuryl alcohol, or 2.5 parts by weight plasticizer+77.25 parts by weight furfuryl alcohol, or 5 parts by weight plasticizer+74.75 parts by weight furfuryl alcohol, and so forth).

To establish the base case, furan binder systems containing no plasticizer were also prepared by mixing 20 parts by weight of a reactive furan resin, 0.25 parts by weight of SILANE 1100, and 79.75 parts by weight furfuryl alcohol. The experimental data generated using these furan binder systems permit proper comparison with the furan binder systems that did include plasticizer The reactive furan resin used in these experiments was CHEM-REZ PFP-99. The ESBO used in these experiments was PLAS-CHECK 775. The ELO used in these experiments was PLASTHALL ELO.

A foundry molding mix was prepared using each of the furan binder systems described above. These foundry molding mixes were prepared by first adding 6 parts by weight of a catalyst to 3000 parts by weight of a foundry aggregate (refractory material) and mixing to combine. Once combined, 30 parts by weight of a furan binder system was added to the sand-catalyst mixture and mixed to combine, providing the foundry molding mix. The curing catalyst used in all cases was an CHEM-REZ C090B Catalyst (aromatic sulfonic acid) dissolved in water. WEDRON 410 silica sand was the foundry aggregate.

Five test samples were made from each foundry molding mix. These test samples were made by forcing the foundry molding mix into a multiple transverse bar shape pattern (2.54 cm×1.27 cm×20.32 cm), ensuring that the molds were set before the work time was reached. The mold shapes were allowed to set until the strip time was reached. The shapes were released from the pattern and placed in an environment of constant temperature and humidity to continue curing. At intervals of two hours and twenty-four hours, the bars were analyzed in a Thwing Albert QC-3A three-point bend tester with a 17.78 cm span to determine the tensile strength, elasticity, and total energy absorption (TEA). The tensile strength, elongation, and TEA values reported in Tables 1 and 2, below, are the numerical averages obtained from each set of five test samples.

Results: 2 Hour Tests

In the results reported, the row labeled "NONE" describes the average values for a reactive furan resin containing no plasticizer. These values for strength, elongation, and TEA are used as the target for the corresponding 2 hr plasticizer tensile strengths. It would be expected that replacement of the furfuryl alcohol component with plasticizer should inherently lower tensile performance.

TABLE 1

Transverse results for increasing levels of polyester polyol (PEPO), epoxidized soybean oil (ESBO), and epoxidized linseed oil (ELO) at 2 hr cure times.

| TYPE | LEVEL (wt. %) | 2 hr - Strength (N) | 2 hr - Elongation (mm) | 2 hr - TEA (J/m^2) |
|---|---|---|---|---|
| NONE | 0 | 40.56 | 0.78 | 4.884 |
| PEPO | 1 | 49.02 | 0.98 | 8.224 |
| ESBO | 1 | 49.7 | 0.875 | 7.125 |
| ELO | 1 | 59.9 | 0.94 | 8.642 |
| PEPO | 2.5 | 46.8 | 1.08 | 9.172 |
| ESBO | 2.5 | 49.32 | 1.1 | 9.2 |
| ELO | 2.5 | 50.82 | 0.96 | 8.32 |
| PEPO | 5 | 44.26 | 0.92 | 6.784 |
| ESBO | 5 | 43.04 | 1.38 | 11.14 |
| ELO | 5 | 45.88 | 1.32 | 11.954 |
| PEPO | 7.5 | 38.2 | 1.05 | 7.505 |
| ESBO | 7.5 | 48.04 | 1.36 | 12.72 |
| ELO | 7.5 | 45.82 | 1.4 | 12.316 |
| PEPO | 10 | 39.74 | 1.3 | 11.302 |
| ESBO | 10 | 46.575 | 1.3 | 11.5175 |
| ELO | 10 | 55.3 | 1.52 | 17.32 |
| PEPO | 15 | 20.875 | 2.6 | 15.2775 |
| ESBO | 15 | 41.725 | 1.025 | 10.89 |
| ELO | 15 | 38.88 | 1.5 | 16.356 |

As seen, the addition of each plasticizer at the 1.0 wt. % level provided a moderate improvement in tensile strength over the base case. Both PEPO and ESBO showed notable improvements, but ELO showed a more significant improvement.

Each plasticizer improved elongation from the base case at the 1.0 wt. % level, although PEPO showed the most improvement, followed closely by ELO.

Total energy absorption (TEA) values for each plasticizer at the 1.0 wt. % level was significantly greater than for the base case. ELO showed the greatest improvement in this case.

It may be reasonably concluded that, at even the 1.0 wt. % level, the plasticizers each notably improved the performance over the base case, with ELO performing the best.

As the amount of plasticizer was increased to 2.5 wt. %, the tensile strengths decreased from those observed at the 1.0 wt. % level, although the base case tensile strength was exceeded by each plasticizer. ESBO and ELO were each better at maintaining tensile strength, when compared to PEPO. As the amount of plasticizer increased, elongation on each sample increased from the 1.0 wt. % values. ESBO exhibited the best increase elongation. ESBO outperformed both ELO and PEPO in total energy absorption.

When the plasticizer levels were increased to 5.0 wt. %, tensile strength significantly decreased in each case from the 2.5 wt. % level. Without asserting it as the basis for the decrease, the lower levels of furfuryl alcohol may be responsible for this drop. To the extent that the decreased tensile strength can be tolerated, the dramatic increase in elongation, especially with the epoxidized plant seed oils, may provide an acceptable tradeoff. This is also seen in TEA, where the epoxidized plant seed oils significantly outperformed PEPO. It should be recalled here that one of the objects is to be able to replace PEPO for environmental and health reasons, so the significant increase in TEA from the plant oils may be considered unexpected.

Moving to the 7.5 wt. % level, the tensile strength for PEPO continues to drop, ELO holds relatively flat and ESBO shows an increase. Elongation for the ESBO drops slightly, while PEPO and ELO experience increases. Regardless, both ESBO and ELO still exhibit higher elongation and strength than PEPO and the sample without plasticizer. When TEA is measured, the epoxidized plant seed oils continued to separate positively from the values seen for either PEPO or the base case.

As the plasticizer level is increased to 10 wt. %, the tensile strength for both PEPO and ELO increase, and the ESBO tensile strength decreases. Similarly, elongation for PEPO and ELO continues to increase, while ESBO sees about the same elongation. Total energy absorption also shows similar results for PEPO and ESBO show similar TEA values, while ELO displays the highest TEA value seen in the tests, at a level that is significantly higher than the PEPO counterpart, and dramatically higher than the sample containing no plasticizer.

Finally, the addition of 15 wt. % plasticizer shows a drop in strength for all samples, and for the elongation of ESBO, and ELO. Interestingly, PEPO continues to show increases in elongation, though the PEPO tensile strength is quite low. Consequently, TEA values for PEPO increased at 15 wt. %, but decreased slightly for ESBO and ELO. Regardless, ELO continued to exhibit higher TEA values than its PEPO counterpart, and consistently higher than the sample not containing plasticizer.

The results seen as the plasticizer level increases at or above 7.5 wt. % might be suggestive that plasticizer-plasticizer reactivity begins to compete with plasticizer-modified furan resin reactivity.

Overview of the 2 hr cure results demonstrate the importance of balance in determination of plasticizer addition percentages. Excess plasticizer can result in low strengths due to the aforementioned loss of monomeric building blocks for the polymer, while the opposite generally results in higher strength, but lower elasticity. Each situation ultimately results in low TEA values. In the case of 2 hr cures, the effective range can be seen to be in the 5.0 wt. % to 7.5 wt. % range, and probably would be seen to be in the 4.0 wt. % to 9.0 wt. % range if tests had been made at those levels. In that range, either ELO or ESBO significantly outperforms PEPO and the base case.

Results: 24 Hour Tests

As with the 2 hr tests, a base case was established for samples after twenty-four hours of cure time, indicated in Table 2 below as NONE. These values for strength, elongation, and TEA obtained when no plasticizer was present are useful as the target for the corresponding 24 hr plasticizer tensile strengths. It would be expected that replacement of the FA component with plasticizer should inherently lower tensile performance.

TABLE 2

Transverse results for increasing levels of polyester polyol (PEPO), epoxidized soybean oil (ESBO), and epoxidized linseed oil (ELO) at 24 h cure times.

| TYPE | LEVEL (wt. %) | 24 hr - Strength (N) | 24 hr - Elongation (mm) | 24 hr - TEA (J/m^2) |
|---|---|---|---|---|
| NONE | 0 | 51.075 | 0.875 | 5.5075 |
| PEPO | 1 | 62.625 | 0.825 | 7.8575 |
| ESBO | 1 | 61.625 | 0.9 | 7.58 |
| ELO | 1 | 71.3 | 1.05 | 7.6475 |
| PEPO | 2.5 | 66.6 | 1.025 | 9.4125 |
| ESBO | 2.5 | 71.85 | 1.025 | 10.7675 |
| ELO | 2.5 | 69.575 | 1.125 | 10.2125 |
| PEPO | 5 | 55.1 | 0.925 | 6.585 |

TABLE 2-continued

Transverse results for increasing levels of polyester polyol (PEPO), epoxidized soybean oil (ESBO), and epoxidized linseed oil (ELO) at 24 h cure times.

| TYPE | LEVEL (wt. %) | 24 hr - Strength (N) | 24 hr - Elongation (mm) | 24 hr - TEA (J/m^2) |
|---|---|---|---|---|
| ESBO | 5 | 73.125 | 1.05 | 11.58 |
| ELO | 5 | 63 | 0.95 | 7.8 |
| PEPO | 7.5 | 49.55 | 0.85 | 5.825 |
| ESBO | 7.5 | 72.625 | 1.225 | 14.0075 |
| ELO | 7.5 | 68.325 | 1.075 | 10.41 |
| PEPO | 10 | 71.625 | 1.125 | 11.615 |
| ESBO | 10 | 72.6 | 1.25 | 15.2975 |
| ELO | 10 | 79.1 | 1.225 | 14.6225 |
| PEPO | 15 | 63.92 | 0.88 | 11.18 |
| ESBO | 15 | 52.74 | 0.9 | 10.724 |
| ELO | 15 | 60.76 | 1 | 13.7 |

The 24 hr sample results show similar trends to the 2 hr sample results. Provided that tensile strength remains at an at least acceptable level in a binder formulation, a focus on the TEA values is proper as a general representation of the effects of plasticizer on the resin. At the 1.0 wt. % level, all three plasticizers tested show similar values, although PEPO slightly outperforms the plant-based ELO and ESBO.

At the 2.5 wt. % level, both plant-oil based plasticizers are consistent in tensile strength with PEPO and exceed the TEA of PEPO. At the 5.0 wt. % level, the addition shows an increase for ESBO, but a decrease in both PEPO and ELO, with ELO and ESBO still performing better than the standard PEPO. Similar to 2 h cure times, the use of the plant seed-oil based plasticizers at the 7.5 wt. % level shows a significant increase in TEA for ESBO and ELO, while PEPO continues to drop. At this percentage, ESBO vastly outperforms PEPO and the sample without plasticizer, while ELO does as well to a lesser degree. Addition of the plasticizers at 10 wt. % shows increases in TEA of all plasticizers, though ESBO and ELO continue to perform better than the PEPO. At 15 wt. %, all of the plasticizers show a decrease from the values from the 10 wt. % level, presumably due to excess plasticizer. The TEA of PEPO and ESBO are similar, while ELO performs best at this level of addition.

From these test data, the 24 hr mold shapes would appear to perform in a manner similar to the 2 hr mold shapes, with the effective range seen to be in the 5.0 wt. % to 7.5 wt. % range, and probably in the 4.0 wt. % to 9.0 wt. % range if tests had been made at those levels. In that range, either ELO or ESBO significantly outperforms PEPO and the base case.

To review the effects of cure time, one way to compare the data would be to normalize the tensile strengths and TEA values with respect to the data obtained when no plasticizer was used ("NONE"). For example, at 1.0% by weight and 2 hr of cure time, the PEPO plasticizer had a tensile strength of 49.02 N and a TEA of 8.224 J/m$^2$. The base case NONE had a tensile strength of 40.96 N and a TEA of 4.884 J/m$^2$. Normalizing, the dimensionless ratios are 1.21 and 1.68. Thus, Table 3 allows the effects of cure time to be compared.

TABLE 3

Normalized comparison of polyester polyol (PEPO), epoxidized soybean oil (ESBO), and epoxidized linseed oil (ELO) to no plasticizer (NONE) at 2 hr & 24 hr cure times.

| TYPE | LEVEL (wt. %) | Strength 2 hr | Strength 24 hr | TEA 2 hr | TEA 24 hr |
|---|---|---|---|---|---|
| NONE | 0 | 1.00 | 1.00 | 1.00 | 1.00 |
| PEPO | 1 | 1.21 | 1.23 | 1.68 | 1.43 |

TABLE 3-continued

Normalized comparison of polyester polyol (PEPO), epoxidized soybean oil (ESBO), and epoxidized linseed oil (ELO) to no plasticizer (NONE) at 2 hr & 24 hr cure times.

| TYPE | LEVEL (wt. %) | Strength 2 hr | Strength 24 hr | TEA 2 hr | TEA 24 hr |
|---|---|---|---|---|---|
| ESBO | 1 | 1.23 | 1.21 | 1.46 | 1.38 |
| ELO | 1 | 1.48 | 1.40 | 1.77 | 1.85 |
| PEPO | 2.5 | 1.15 | 1.30 | 1.88 | 1.71 |
| ESBO | 2.5 | 1.22 | 1.41 | 1.88 | 1.96 |
| ELO | 2.5 | 1.25 | 1.36 | 1.70 | 1.85 |
| PEPO | 5 | 1.09 | 1.08 | 1.39 | 1.20 |
| ESBO | 5 | 1.06 | 1.43 | 2.28 | 2.10 |
| ELO | 5 | 1.13 | 1.23 | 2.45 | 1.42 |
| PEPO | 7.5 | 0.94 | 0.97 | 1.54 | 1.06 |
| ESBO | 7.5 | 1.18 | 1.42 | 2.60 | 2.54 |
| ELO | 7.5 | 1.13 | 1.34 | 2.52 | 1.89 |
| PEPO | 10 | .98 | 1.40 | 2.31 | 2.11 |
| ESBO | 10 | 1.15 | 1.42 | 2.36 | 2.78 |
| ELO | 10 | 1.36 | 1.55 | 3.55 | 2.66 |
| PEPO | 15 | 0.51 | 1.25 | 3.13 | 2.03 |
| ESBO | 15 | 1.03 | 1.03 | 2.23 | 1.95 |
| ELO | 15 | 0.96 | 1.19 | 3.35 | 2.49 |

Both epoxidized soybean oil, and epoxidized linseed oil demonstrate viability as alternatives to aromatic polyester polyols as a plasticizer in furan resin systems. Other unsaturated plant-seed oils having a suitable molecular weight, such as industrial-grade rapeseed oil, cottonseed oil and sunflower oil may be useful after being epoxidized. At 2 hr cure times, ESBO and ELO exhibited maximum transverse improvement at 5.0 wt. %-7.5 wt. %. At 24 hr cure times maximum improvement was seen at 7.5 wt. %-10 wt. %. In the majority of the additive percentages, ESBO and ELO displayed better TEA values and higher average strength than PEPO, thus highlighting the improved ability of the non-food-based and non-fossil fuel-based plasticizers to replace fossil-fuel based plasticizers, especially polyester polyols containing phthalates, as plasticizers in furan resin systems. The potential for providing furan resin binders that are devoid of phthalate plasticizers will justify, in some instances, the replacement of a plant-seed oil plasticizer for the phthalate-based plasticizer.

Experimental Protocol: Methylated ESBO and Epoxidized 2-Ethylhexyl Tallate

A second round of experiments tested methylated ESBO and epoxidized 2-ethylhexyl tallate as plasticizers in furan binder systems.

To obtain the methylated ESBO used in these experiments, PLAS-CHECK 775 was saponified with NaOH and then esterified with methanol using the following procedure: 100 parts by weight of PLAS-CHECK 775, 46 parts by weight of methanol, 5 parts by weight of acetone, and 1.1 parts by weight of NaOH were mixed at room temperature for one hour; then the resulting mixture was washed with water 4 times in a separatory funnel to remove the NaOH; and then the organic layer was then dried to less than 2% water with magnesium sulfate. The trans-esterified product, methylated epoxidized soybean oil, was confirmed with GC-MS.

The epoxidized 2-ethylhexyl tallate (CAS 61789-01-3) was obtained from a commercial source. It had an epoxidation degree of 4.7%.

For both of these plasticizers, a series of furan binder systems was prepared by mixing 20 parts by weight of a reactive furan resin, 0.25 parts by weight of SILANE 1100, 5 parts by weight plasticizer, and 74.75 parts by weight furfuryl alcohol.

To establish the base case, furan binder systems containing no plasticizer were also prepared by mixing 20 parts by weight of a reactive furan resin, 0.25 parts by weight of SILANE 1100, and 79.75 parts by weight furfuryl alcohol. The experimental data generated using these furan binder systems permit proper comparison with the furan binder systems that did include plasticizer The reactive furan resin used in these experiments was CHEM-REZ PFP-99.

A foundry molding mix was prepared using each of the furan binder systems described above. These foundry molding mixes were prepared by first adding 10.5 parts by weight of a catalyst to 3000 parts by weight of a foundry aggregate (refractory material) and mixing to combine. Once combined, 30 parts by weight of a furan binder system was added to the sand-catalyst mixture and mixed to combine, providing the foundry molding mix. The curing catalyst used in all cases was an CHEM-REZ C090B Catalyst (aromatic sulfonic acid) dissolved in water. WEDRON 410 silica sand was the foundry aggregate.

Five test samples were made from each foundry molding mix. These test samples were made by forcing the foundry molding mix into a multiple transverse bar shape pattern (2.54 cm×1.27 cm×20.32 cm), ensuring that the molds were set before the work time was reached. The mold shapes were allowed to set until the strip time was reached. The shapes were released from the pattern and placed in an environment of constant temperature and humidity to continue curing. At intervals of two hours and twenty-four hours, the bars were analyzed in a Thwing Albert QC-3A three-point bend tester with a 17.78 cm span to determine the tensile strength, elasticity, and total energy absorption (TEA). The tensile strength, elongation, and TEA values reported in Tables 1 and 2, below, are the numerical averages obtained from each set of five test samples.

Results: 2 Hour Tests

TABLE 4

Transverse results for methylated ESBO and epoxidized 2-ethylhexyl tallate at 2 hr cure times.

| TYPE | LEVEL (%) | 2 h - Strength (N) | 2 h - Elongation (mm) | 2 h - TEA (J/m^2) |
|---|---|---|---|---|
| None | 0 | 62.44 | 1.04 | 8.712 |
| PEPO | 5 | 57.9 | 1.02 | 8.696 |
| Methylated ESBO | 5 | 60.8 | 1.12 | 10.71 |
| Epoxidized 2-EH Tallate | 5 | 59.08 | 1.06 | 10.036 |

As seen, the addition of either methylated ESBO or epoxidized 2-ethylhexyl tallate at the 5.0% level improved elongation and TEA over the base case (NONE), with the improvements in TEA being the most pronounced. At the 5.0% level, methylated ESBO and epoxidized 2-ethylhexyl tallate also outperformed PEPO in all three metrics.

Between methylated ESBO and 2-ethylhexyl tallate, methylated ESBO performed slightly better in all three metrics.

Results: 24 Hour Tests

TABLE 5

Transverse results for methylated ESBO and epoxidized 2-ethylhexyl tallate at 24 hr cure times.

| TYPE | LEVEL (%) | 24 h - Strength (N) | 24 h - Elongation (mm) | 24 h - TEA (J/m^2) |
|---|---|---|---|---|
| None | 0 | 69.92 | 0.98 | 5.122 |
| PEPO | 5 | 71.44 | 1.06 | 5.478 |
| Methylated ESBO | 5 | 77.12 | 1.08 | 5.85 |
| Epoxidized 2-EH Tallate | 5 | 86.08 | 1.10 | 7.356 |

As seen, the addition of methylated ESBO at the 5.0% level improved strength, elongation, and TEA over the base case (NONE), with the improvements in strength being the most pronounced. Methylated ESBO also outperformed PEPO in all three metrics, though most significantly in strength.

As seen, the addition of epoxidized 2-ethylhexyl tallate at the 5.0% level improved strength, elongation, and TEA over the base case (NONE), with the improvements in strength and TEA being the most pronounced. Methylated ESBO also outperformed PEPO in all three metrics, though most significantly in strength and TEA.

Between methylated ESBO and 2-ethylhexyl tallate, methylated ESBO produced slightly better elongation results and significantly better strength and TEA results.

What is claimed is:

1. A binder system for metal casting, comprising:
a reactive furan resin;
furfuryl alcohol;
an activator; and
a plasticizer comprising an epoxidized fatty acid, wherein the plasticizer is present in an amount ranging from about 1.0 wt. % to about 15.0 wt. % based on the total weight of the binder system.

2. The binder system of claim 1, wherein the epoxidized fatty acid comprises an unsaturated chain with about 14 to about 22 carbon atoms.

3. The binder system of claim 1, wherein the plasticizer comprises an epoxidized plant seed oil that comprises the epoxidized fatty acid.

4. The binder system of claim 3, wherein the epoxidized plant seed oil comprises at least one of: epoxidized soybean oil, epoxidized linseed oil, epoxidized rapeseed oil, epoxidized cottonseed oil, and epoxidized sunflower oil.

5. The binder system of claim 4, wherein the plasticizer comprises at least one of:
epoxidized soybean oil with an epoxidation degree of about 7.1%; and
epoxidized linseed oil with an epoxidation degree of about 9.0%.

6. The binder system of claim 3, wherein the epoxidized plant seed oil is methylated.

7. The binder system of claim 1, wherein the epoxidized fatty acid is 2-ethylhexyl tallate.

8. The binder system of claim 1, wherein:
the reactive furan resin comprises a furan resin modified with phenolic resole; and
the reactive furan resin is present in an amount ranging from about 18 wt. % to about 22 wt. % based on the total weight of the binder system.

9. The binder system of claim 1, wherein the furfuryl alcohol and the plasticizer are collectively present in an amount ranging from about 75 wt. % to about 85 wt. % based on the total weight of the binder system.

10. A foundry molding mix for metal casting, comprising:

a foundry aggregate; and a binder system according to claim 1.

11. The foundry molding mix of claim 10, wherein the binder system is present in the range of from about 0.5 wt. % to about 5.0 wt. % based on weight of the foundry aggregate.

12. A method for preparing a foundry shape, comprising the steps of:

activating a foundry molding mix by mixing the binder system of claim 1 with a foundry aggregate;

working the activated foundry molding mix in a mold or pattern to form a foundry shape;

allowing the foundry shape to cure in the mold or pattern for a dwell time sufficient to cure the foundry shape; and removing the cured foundry shape from the mold or pattern.

13. A foundry shape prepared by the method of claim 12.

14. A metal casting prepared by the steps of:

pouring molten metal into a foundry shape of claim 13;

allowing the molten metal to cool and solidify; and separating the metal casting from the foundry shape.

* * * * *